US005312058A

United States Patent [19]

Brandt et al.

[11] Patent Number: 5,312,058

[45] Date of Patent: May 17, 1994

[54] DEVICE FOR CUTTING A WEB OF MATERIAL

[75] Inventors: Dieter Brandt, Sundsvall, Sweden; Luzian Kies, Düsseldorf; Heinrich Klingen, Kaarst, both of Fed. Rep. of Germany

[73] Assignee: Jagenberg Aktiengesellschaft, Dusseldorf, Fed. Rep. of Germany

[21] Appl. No.: 860,510

[22] Filed: Jun. 11, 1992

[30] Foreign Application Priority Data

Nov. 3, 1990 [DE] Fed. Rep. of Germany .... 4034997.3

[51] Int. Cl.[5] ..... B26D 1/06; B26D 7/02

[52] U.S. Cl. ..... 242/56 R; 83/150; 83/460; 83/582; 83/614; 242/65

[58] Field of Search ..... 83/614, 460, 582, 937, 83/150; 242/56 R, 58.2, 66, 65

[56] References Cited

U.S. PATENT DOCUMENTS

| | | | |
|---|---|---|---|
| 2,266,995 | 12/1941 | Schultz | 164/84.5 |
| 3,111,285 | 11/1963 | Coker | 242/75.2 |
| 3,195,827 | 7/1965 | Schowerer et al. | 242/58.2 X |
| 3,277,761 | 10/1966 | Dreher | 83/614 |
| 3,727,853 | 4/1973 | Kinoshita | 242/56 A |
| 3,779,121 | 12/1973 | Lagain | 83/614 |
| 3,877,332 | 4/1973 | Roch | 83/13 |
| 3,977,310 | 8/1976 | Keck | 93/585 T |
| 4,098,155 | 7/1978 | Insolio | 83/614 X |
| 4,133,495 | 1/1979 | Dowd | 242/66 |
| 4,177,410 | 12/1979 | Dowd | 318/163 |
| 4,864,906 | 9/1989 | Hall | 83/614 X |

FOREIGN PATENT DOCUMENTS

| | | |
|---|---|---|
| 0327725 | 8/1989 | European Pat. Off. . |
| 1749743 | 8/1957 | Fed. Rep. of Germany . |
| 1449677 | 3/1972 | Fed. Rep. of Germany . |
| 1935583 | 5/1972 | Fed. Rep. of Germany . |
| 2920707 | 12/1980 | Fed. Rep. of Germany . |
| 8209958 | 8/1982 | Fed. Rep. of Germany . |
| 3109587 | 11/1982 | Fed. Rep. of Germany . |
| 3611895 | 10/1987 | Fed. Rep. of Germany . |
| 139244 | 10/1978 | German Democratic Rep. . |

OTHER PUBLICATIONS

Patent Abstracts of Japan, vol. 8, No. 227 (M-332) (1664) Oct. 18, 1984 and JP,A,59 108 653 (Kataoka Kikai Seisakusho KK) Jun. 23, 1984.

*Primary Examiner*—Richard K. Seidel
*Assistant Examiner*—Kenneth E. Peterson
*Attorney, Agent, or Firm*—Herbert Dubno

[57] ABSTRACT

In winding machine for material webs (4), particularly paper or cardboard webs, it is known to provide devices for severing the material web (4) on the bearing or support cylinder (1), which have a cutting element applicable to the web (4) in a wrapped area of the bearing or support cylinder (1) and movable across the running direction of the web.

In order to achieve through a simple construction a safe severing of the web (4) during roll exchange, according to the invention a freely rotatably supported wheel (19) having a sharp peripheral edge which can be resiliently pressed against the bearing or support cylinder (1) is used as a cutting element.

5 Claims, 3 Drawing Sheets

DEVICE FOR CUTTING A WEB OF MATERIAL

CROSS REFERENCE TO RELATED APPLICATION

This is a national phase application of PCT/EP 91/02032 filed Oct. 28 1991 and based, in turn, upon German National Application P40 34 997.7 of Nov. 3 1990.

Field of the Invention

The invention relates to a device for cutting a web of material, particularly a paper or cardboard web, on the bearing or support cylinder of a winding machine. In particular, the invention relates to a device for cutting a web of material, particularly a paper or cardboard web, on the bearing or support cylinder of a winding machine, and having a cutting element applicable to the web in a wrapped area of the bearing or support cylinder and movable across the running direction of the web.

Background of the Invention

In winding machines for paper or cardboard webs, during roll replacement, it is necessary to reliably cut across the individual webs produced through longitudinal slitting of the main or full-width web. In order to perform the roll exchange as quickly as possible, the severing of the web takes place suitably on the support or bearing cylinder. Specifically the severing is effected at the location where the new web beginnings created when the web is severed are in the position required for winding onto the new winding rolls.

From the DE-OS 29 20 707 a winding machine with support cylinders is known wherein the severing of the web is performed by a cutting device which raises through the gap between the support cylinders, the web being torn off by its tearing blade at the discharge of the full winding roll. The newly created web beginnings (leading edges of the webs) are held in place by means of underpressure (suction) at the support cylinder designed as a suction cylinder until new winding cores are inserted. A repositioning of the web leading edges for the winding process is not required.

This advantageous cutting device cannot be used in winding machines with support cylinders wherein the winding rolls during the winding process rest on a single support cylinder along two winding lines on both sides of the apex line, because the full winding rolls of the two winding lines are removed from the machine in opposite directions—in and against the travel direction of the web.

For the separation of the web in winding machine with support cylinders, the DE-OS 36 11 895 discloses a device, wherein a scraper blade can be superposed on the web in the wrapped area of the support cylinder and can be moved across the running direction of the web. The cutting edge of the scraper blade has a saw-like construction and severs the web when moved across the running direction of the web.

Practice has proven that the saw-like scraping blades are very expensive, since they require great force for the severing of the web.

OBJECT OF THE INVENTION

It is the object of the invention to provide an improved cut-off device so that with a simple construction it is possible to safely sever the web during roll exchange.

SUMMARY OF THE INVENTION

This object is attained by a cut-off device at the bearing or support cylinder which has a freely rotatably supported wheel having a sharp peripheral edge and which is resiliently pressed against the bearing or support cylinder.

According to the invention, therefore, a rotatable wheel, sharpened at its circumference is used, which weakens the web to an extent where it can be torn off by the increased web traction at the raising or lowering of the winding rolls during discharge. The resilient support limits the contact pressure, so that damage to the cylinder surface can be avoided. According to the invention, the wheel can be made of hard metal or hardened tool steel. That wheel can be supported at the extremity of a peg inclined with respect to the travel direction. The peg can be fastened to the piston bracket of a piston-cylinder unit without a piston rod, extending over the work width.

The device described can be fastened to a lowering platform for the full winding rolls. Moreover, on the lowering platform, underneath the cutting device, an inflatable clamping hose extending over the work width can be provided for clamping the web to the bearing or support cylinder.

While the wheel made of hard metal or hardened tool steel insures a long service life, the positioning of the wheel on an inclined pivot, has proven particularly advantageous, since this yields good severing results with application of minimum force.

The inflatable clamping hose prevents detrimental propagation of the elevated web traction during the separation of the web.

BRIEF DESCRIPTION OF THE DRAWING

The above and other objects, features and advantages of the invention will become more readily apparent from the following description, reference being made to the accompanying highly diagrammatic drawing in which.

DESCRIPTION

Figure 1:
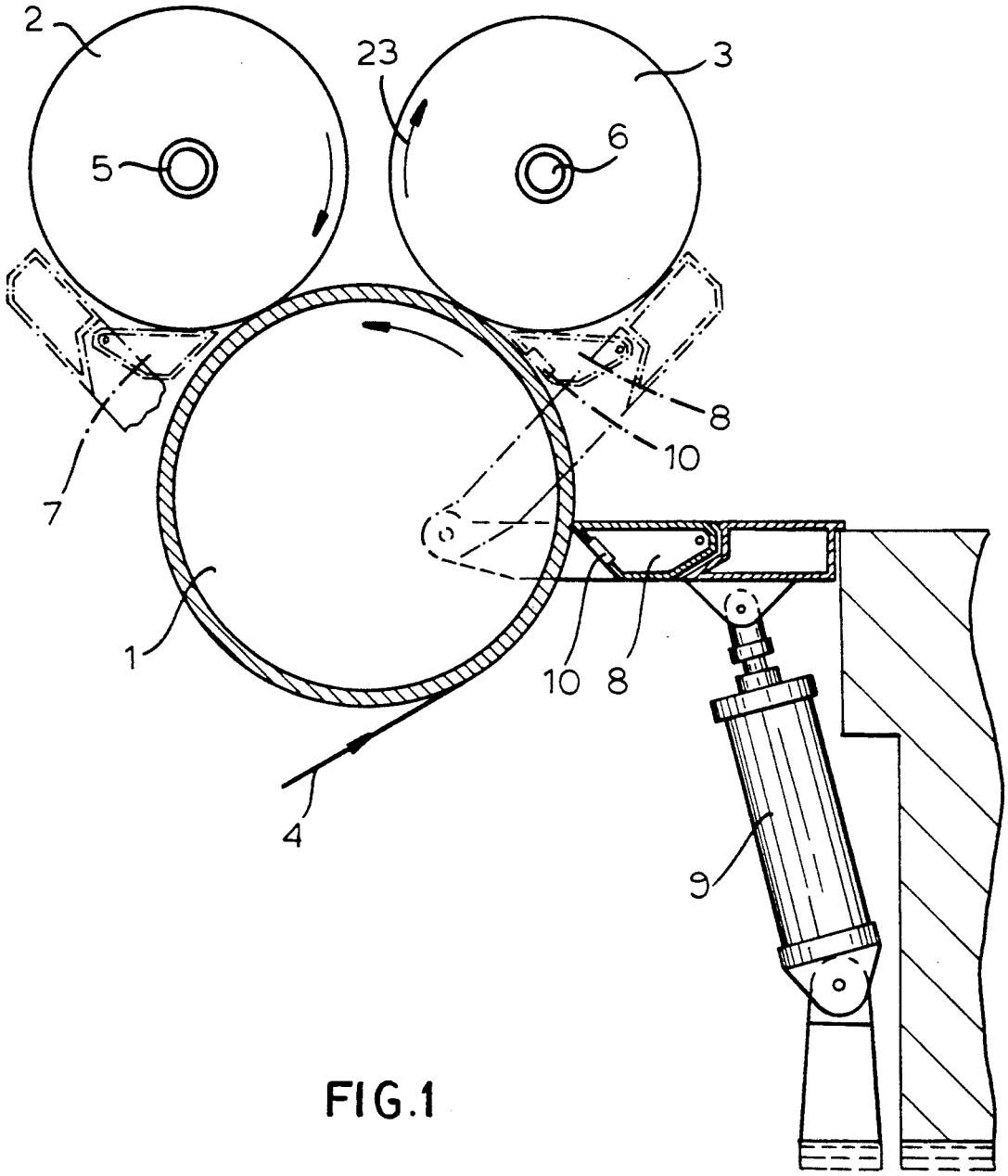
FIG. 1 shows a lateral view of a winding machine with the support cylinder in section, with the severing device integrated in lowering platform.

The winding machine shown in FIG. 1 in a lateral view in section has a support cylinder 1 formed as a suction cylinder, upon which rest the winding rolls 2, 3 during the winding of the web 4 which is a paper or cardboard web.

The winding rolls 2, 3 are each held by the guide heads 5, 6 which are laterally insertable into the winding rolls. Prior to winding, the web 4 is longitudinally slit into several individual webs, which are alternately guided towards the winding lines arranged on both sides of the apex of support cylinder 1 and there they are wound into aligned rolls 2, 3.

In order to remove the winding rolls 2, 3 from the machine, two lowering platforms 7, 8 are provided, each of them can be raised to the bottom of the winding rolls 2, 3 by means of piston-cylinder units 9. After the guide heads 5, 6 are retracted from the winding rolls 2, 3, the lowering platforms 7, 8 are lowered and the winding rolls 2, 3 are discharged. The lowering platform 7 on the incoming side is shown only in part in FIG. 1.

Figure 2:
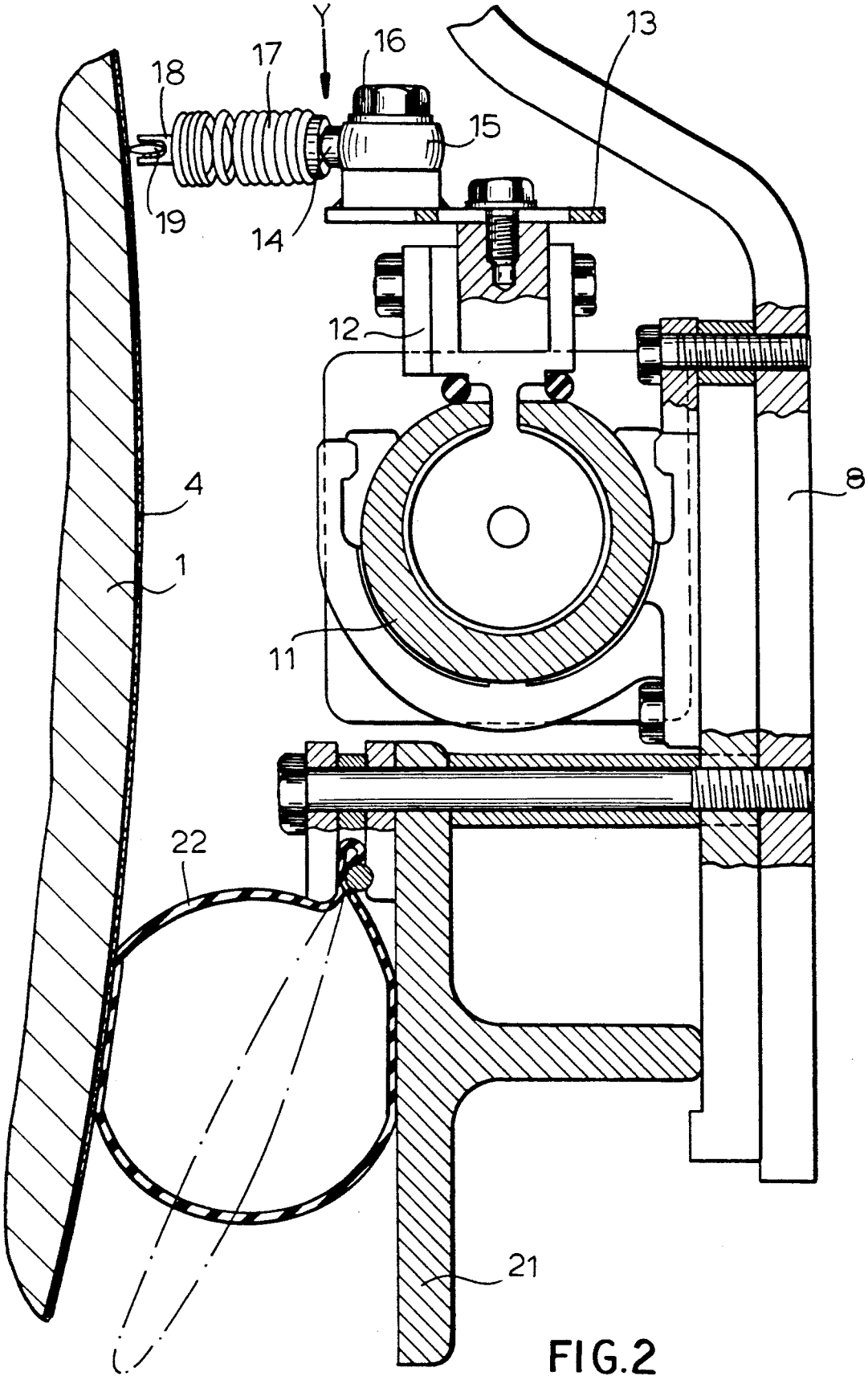
FIG. 2 is an enlarged section of the device of FIG. 1.
Figure 3:
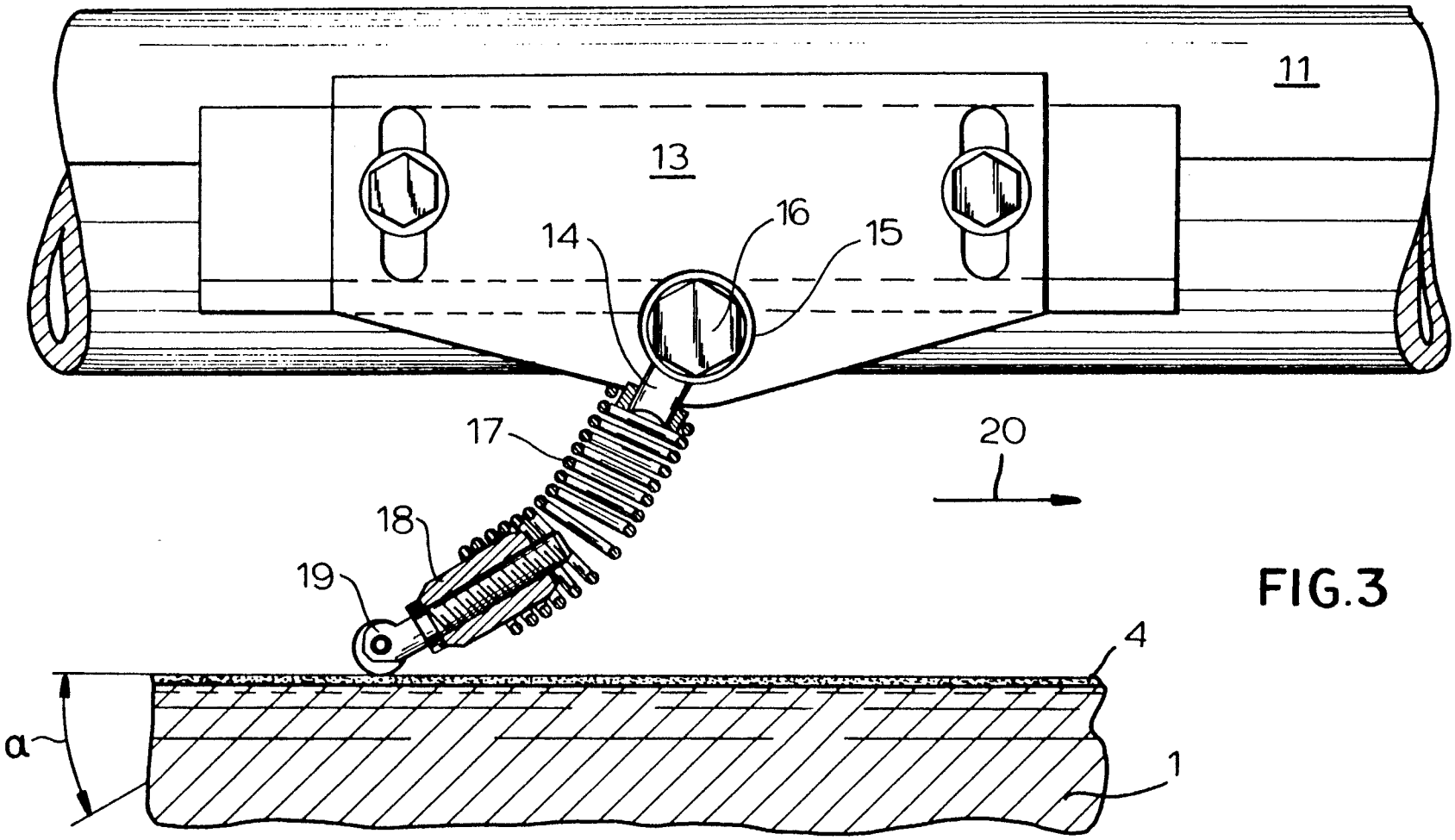
FIG. 3 is a top view in the direction of arrow "Y" in FIG. 2.

A cutting device 10 integrated in the lowering platform 8 on the outgoing side, which is shown enlarged in FIGS. 2 and 3, serves for severing the web 4.

On the side of the lowering platform 8 facing the support cylinder 1, a pneumatic piston cylinder unit 11 without a piston rod, extending over the entire work width, is mounted. A plate 13 is screwed to the piston bracket 12 of the piston-cylinder unit 11 and a short lever 14 which can be secured in a certain position is linked to the side of the plate facing the support cylinder 1. For this purpose the lever 14 has a bearing eye 15 which can be fastened to the plate 13 by means of a screw 16, in order to establish the setting angle with respect to support cylinder 1.

The free end of lever 14 is fitted in a helical spring 17 and securely fastened thereto, a peg 18 with a forked-shaped extension at its end is fastened to the other extremity of the helical spring 17. In this fork-shaped extension a wheel 19 made of hard metal or of hardened tool steel with a sharp peripheral cutting edge is freely rotatably supported in the fashion of a glass cutter. The wheel 19 has a diameter of approximately 5 mm.

In order to make sure that during its movement across the travel direction of the web it rolls off the web 4 supported by support cylinder 1, its axis of rotation runs perpendicularly with respect to the support cylinder axis. When the lowering platform 8 is swung towards the support cylinder 1, the wheel 19 is pressed against the web 4 lying on the support cylinder 1. Due to the inclined position of lever 14, the part of the helical spring 17 holding the peg 18 bends, so that the wheel 19 is pressed by the spring 17 against the web 4. The lowering platform 8 is swung far enough to set an angle ranging from 15° to 35° between the axis of the peg 18 and the generatrix of the support cylinder 1 in the working position. Thereby, the peg 18 is in an inclined position with respect to the travel direction (arrow 20), so that the wheel 19 is pulled across the web 4 during the movement.

Underneath the piston-cylinder unit 11, a support plate 21 is fastened to the lowering platform 8 and, to the side of the support plate facing the support cylinder 1, a clamping hose 22 is fastened, which can be correspondingly inflated over the entire work width. When the lowering platform is swung into position, the clamping hose 22 is inflated and expands between the support cylinder 1 and the support plate 21, clamping the web 4 to the support cylinder 1.

When the winding rolls 2, 3 are full, the support cylinder 1 is stopped and the web 4 is held against the support cylinder 1 by air suction. The lowering platforms 7, 8 are raised—as shown in FIG. 1 in broken lines—and thereby the cutting device 10 integrated in lowering platform 8 is brought into the operating position shown in FIGS. 2 and 3. The wheel 19 is pressed by spring 17 against the web 4 supported on support cylinder 1. The clamping hose 22 is inflated, in order to supplement the holding action of air suction during the cutting of web 4. Subsequently, the piston-cylinder unit 11 moves the pressed wheel 19 across the entire web width. Depending on the web thickness, the web is thereby either completely severed or only weakened. As a rule, only a weakening of the web 4 occurs, the complete separation takes place after that due to increase in web traction during the discharge of winding rolls 2, 3. In the winding stations on the incoming side the web traction increases at the lowering of the winding rolls with lowering platform 7, thereby the individual webs wound at these stations are torn off.

In order to increase web traction at the winding stations on the outgoing side, for the purpose of discharge the lowering platform 8 is positioned with a slight distance below the winding rolls 3. After the guide heads 6 are released, the winding rolls 3 roll for a short stretch over the lowering platform 8 and turn thereby in the direction of arrow 23 (FIG. 1). The increase in web traction resulting from this rotation severs the individual webs wound on the outgoing side. The inflated clamping hose 22 thereby prevents the propagation of the web traction increase from reaching the area of the longitudinal slitting device arranged underneath support cylinder 1, where it can cause problems.

The web traction increase of the individual webs wound on the incoming side due to the lowering of lowering platform 7 does not create any problem, since these individual webs wrap around the support cylinder 1 at a large angle, so that the increased web traction cannot propagate. By lowering the lowering platform 8, the piston-cylinder unit 11 with the wheel 19 is brought back to its initial position, ready for the next cutting sequence. After the insertion of new winding cores, the newly created web beginnings are wound onto them. While the web beginnings on the outgoing side can be directly wound onto the inserted winding cores, the web leading edges of the to be wound on the incoming side have first to be transported by the support cylinder 1 to the corresponding winding stations.

We claim:

1. A web winding machine, comprising:

a bearing and support cylinder upon which a roll to be wound is supported and fed with a paper or cardboard web to be wound on said roll, said web lying along said cylinder over a stretch leading to said roll;

a lowering platform alongside said cylinder, said platform having a surface spacedly juxtaposable with said stretch upon displacement of said platform into a position to receive and lower said roll when said roll has been wound with said web;

an inflatable clamping hose on said platform interposed between said surface and said stretch and inflatable to clamp said web against said cylinder for separating said web upon removal of said roll from said cylinder; and a device on said platform for at least weakening said web along a separating line, said device comprising:

a member displaceable across a width of said web, a freely rotatable supported sharp-edged roller engageable with said stretch along said separating line for at least weakening said web upon being drawn therealong by said member, and resilient means between said member and said roller for resiliently biasing said roller against said web and said cylinder, said clamping hose limiting propagation of tension to an oncoming portion of said web upon application of an increased tension to separate said web along said line.

2. The web winding machine defined in claim 1 wherein said wheel is composed of a material selected from a group which consists of hard metal and hardened tool steel.

3. The web winding machine defined in claim 1 wherein said sharp-edged roller is freely rotatable at an end of a peg inclined relative to a direction of travel of said member along said separating line.

4. The web winding machine defined in claim 3 wherein said member is a piston bracket secured to a piston displaceable parallel to said line, said piston being a part of a piston-cylinder unit extending over a width of said web.

5. The web winding machine defined in claim 10 wherein said resilient means is a coil spring secured to said web and to said bracket.

* * * * *